US007577382B2

(12) United States Patent
Sato et al.

(10) Patent No.: US 7,577,382 B2
(45) Date of Patent: Aug. 18, 2009

(54) IMAGE FORMING APPARATUS, PROCESS UNIT, AND DEVELOPING CARTRIDGE

(75) Inventors: Fumikazu Sato, Kounan (JP); Hiroshi Tokuda, Nishikamo-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 142 days.

(21) Appl. No.: 11/526,592

(22) Filed: Sep. 26, 2006

(65) Prior Publication Data

US 2007/0147883 A1 Jun. 28, 2007

(30) Foreign Application Priority Data

Sep. 26, 2005 (JP) ..... 2005-278228

(51) Int. Cl.
*G03G 15/00* (2006.01)

(52) U.S. Cl. ..... 399/167; 399/262; 399/263

(58) Field of Classification Search ..... 399/107, 399/111, 113, 117, 119, 167, 262, 263
See application file for complete search history.

(56) References Cited

U.S. PATENT DOCUMENTS

| | | | | |
|---|---|---|---|---|
| 5,512,984 | A | 4/1996 | Kimura et al. | |
| 6,070,028 | A | 5/2000 | Odagawa et al. | |
| 6,122,470 | A | 9/2000 | Kimura | |
| 6,708,011 | B2 | 3/2004 | Nomura et al. | |
| 6,823,160 | B2 | 11/2004 | Okabe | |
| 7,116,926 | B2 * | 10/2006 | Tsusaka | 399/124 |
| 7,162,174 | B2 * | 1/2007 | Suzuki et al. | 399/64 |
| 7,327,970 | B2 * | 2/2008 | Moon | 399/111 |
| 2003/0185594 | A1 | 10/2003 | Okabe | |
| 2005/0063735 | A1 | 3/2005 | Okabe | |

FOREIGN PATENT DOCUMENTS

| | | | |
|---|---|---|---|
| JP | 4-321057 | A | 11/1992 |
| JP | 7-056417 | | 3/1995 |
| JP | 9-179473 | A | 7/1997 |
| JP | 10-105020 | | 4/1998 |
| JP | 11-249378 | | 9/1999 |
| JP | 2002-149037 | | 5/2002 |
| JP | 2003-015378 | A | 1/2003 |
| JP | 2003-295614 | | 10/2003 |

OTHER PUBLICATIONS

JP Office Action dtd Jan. 27, 2009, JP Appln. 2005-278228.

* cited by examiner

*Primary Examiner*—Hoan H Tran
(74) *Attorney, Agent, or Firm*—Banner & Witcoff, Ltd.

(57) ABSTRACT

An image forming apparatus that includes: a process unit; a driving source; a first driving unit that rotates when a rotation driving force generated by the driving source is transmitted; and a connection switching unit that switches between a transmission state in which the rotation driving force is transmitted to the first driving unit and a non-transmission state. The process unit includes: a transmission permission unit that switches a state of the connection switching unit into the transmission state, when the process unit exists at a process mounting location with respect to the image forming apparatus; and a second driving unit that joints with the first driving unit when the process unit exists at the process mounting location and rotates a rotation driving subject in the process unit by a rotation force of the first driving unit.

11 Claims, 12 Drawing Sheets

IMAGE FORMING APPARATUS, PROCESS UNIT, AND DEVELOPING CARTRIDGE

CROSS REFERENCE TO RELATED APPLICATION

This application claims priority from Japanese Patent Application No. 2005-278228, filed on Sep. 26, 2005, the entire subject matter of which is incorporated herein by reference.

TECHNICAL FIELD

Aspects of the present invention relate to an electrostatographic image forming apparatus employed in a copier, a facsimile, a laser printer, and the like, and a process unit and a developing cartridge for use in the image forming apparatus.

BACKGROUND

Generally, in image forming apparatuses for recording images by supplying a developer to an electrostatic latent image formed on a photosensitive member through a developing roller and transferring visible images formed on the photosensitive member to a recording medium, a cartridge-type process unit is employed in order to facilitate operations for maintenance, replacement, and the like (for example, see JP-A-10-105020).

In the above-described image forming apparatuses, a rotation driving unit is provided on the side of a process unit. In this case, the rotation driving unit rotates in a state in which it is connected to a driving source provided in a main body of the image forming apparatus, causing a photosensitive member or a developer roller to rotate. According to a structure of this image forming apparatus, by closing a cover provided to an opening for attaching or detaching the process unit, a rotation driving force generated by a driving source is transmitted to a rotation driving unit.

According to the above-mentioned image forming apparatus, even in a case in which the process unit is not mounted on the image forming apparatus at a correct location for the process unit to be mounted, or a different kind of a process unit not to be used in the corresponding image forming apparatus is mounted on the image forming apparatus, the cover of the imaging forming apparatus can be closed.

In this case, a driving source of the image forming apparatus or a rotation driving unit of the process unit, or the main body of the image forming apparatus or the process unit may be damaged.

SUMMARY

Aspects of the invention provide an image forming apparatus, a process unit, and a developing cartridge, which can be prevented from being damaged.

DETAILED DESCRIPTION

[General Overview]

Figure 1:
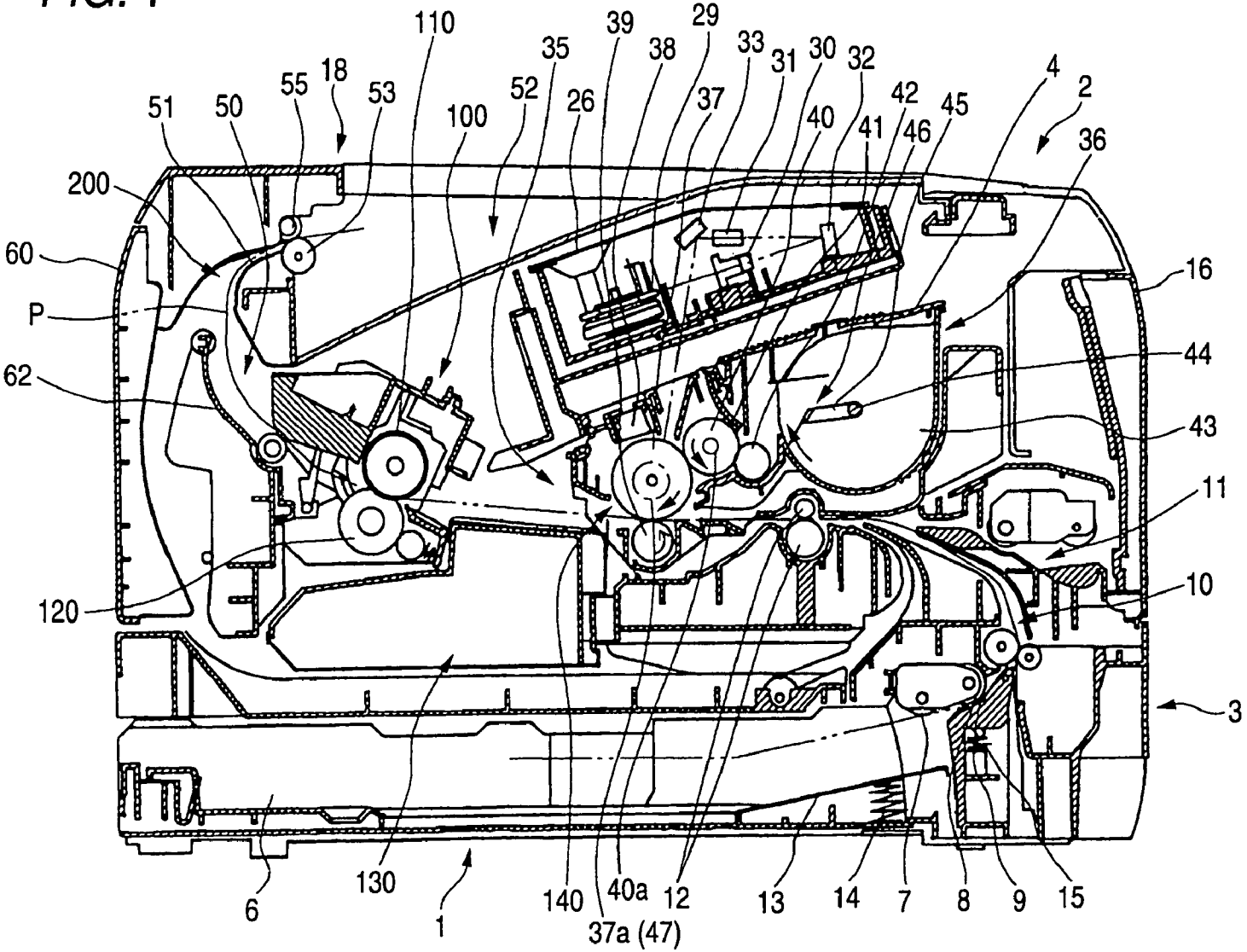
FIG. 1 is a side cross-sectional view schematically illustrating a laser printer.

According to a first aspect of the invention, there is provided an image forming apparatus comprising: a process unit being attachable to and detachable from the image forming apparatus and including a photosensitive member cartridge having a photosensitive member on which an electrostatic latent image is formed, and a developing cartridge having a developing roller for supplying a developer to the photosensitive member, the developing cartridge being attachable to and detachable from the photosensitive member cartridge; a driving source that generates a rotation driving force; a main body side driving unit that rotates when the rotation driving force generated by the driving source is transmitted; and a connection switching unit that switches between a transmission state in which the rotation driving force generated by the driving source is transmitted to the main body side driving unit and a non-transmission state in which the rotation driving force generated by the driving source is not transmitted to the main body side driving unit, wherein the process unit includes: a transmission permission unit that switches a state of the connection switching unit into the transmission state, when the process unit exists at a process mounting location with respect to the image forming apparatus; and a process side driving unit that couples with the main body side driving unit when the process unit exists at the process mounting location and rotates a rotation driving subject in the process unit by a rotation force of the main body side driving unit.

According to this configuration, when the process unit does not exist at the process mounting location that is the mounting location with respect to the image forming apparatus, in a case in which the process unit is not correctly mounted on the image forming apparatus, since the rotation driving force of the driving source is not transmitted to the main body side driving unit, the main body side driving unit does not rotate. Accordingly, it can be prevented that in a state in which the joint between the main body side driving unit and the process side driving unit is incomplete, the main body side driving unit rotates, and the main body side driving unit or the process side driving unit, and the image forming apparatus or the process unit are prevented from being damaged.

According to a second aspect of the invention, in the image forming apparatus according to the first aspect of the invention, the transmission permission unit is a protruding portion that is provided to protrude from the process unit. Further, the connection switching unit includes a mechanical clutch that is movable to a connection location connecting the driving source and the main body side driving unit to each other and a separation location separating the driving source and the main body side driving unit from each other, between the driving source and the main body side driving unit, and a moving action unit that, when the process unit exists at the process mounting location, comes into contact with the protruding portion to be displaced, and moves the mechanical clutch from the separation location to the connection location.

According to this configuration, if the mechanical clutch is constructed to switch the connection between the driving source and the main body side driving unit and the separation between the driving source and the main body side driving unit, since an electronic circuit having a complicated structure or an expensive electronic component does not need to be provided, it is possible to construct the image forming apparatus at the low cost.

According to a third aspect of the invention, in the image forming apparatus according to the second aspect of the invention, when the moving action unit comes into contact with the protruding portion, the moving action unit rotates to be displaced.

According to a fourth aspect of the invention, in the image forming apparatus according to the first aspect of the invention, the transmission permission unit is a predetermined portion in the process unit. Further, the connection switching unit includes a magnetic clutch that switches connection and separation between the driving source and the main body side driving unit, a determination unit that determines that the process unit exists at the process mounting location, when the predetermined portion is detected, and a switching control unit that, when it is determined by the determination unit that the process unit exists at the process mounting location, controls a switching operation of the magnetic clutch, such that the driving source and the main body side driving unit are connected to each other. Further, the predetermined portion is provided at a location detected by the determination unit, when the process unit exists at the process mounting location, in the developing cartridge.

According to this configuration, if the electromagnetic clutch is constructed to switch the connection between the driving source and the main body side driving unit and the separation between the driving source and the main body side driving unit, since a switching mechanism for switching a state of the clutch or a mechanical component does not need to be provided, a structure becomes simplified, and a space can be saved. In addition, the when the electromagnetic clutch is arranged, a degree of freedom in arrangement is improved. Accordingly, it is possible to achieve a structure in which design and assembling are easy.

According to a fifth aspect of the invention, in the image forming apparatus according to any one of the first to fourth aspects of the invention, the rotational driving subject is the photosensitive member, and the main body side driving unit and the process side driving unit are gears that are screwed to each other. In this case, the process side driving unit may be provided on the same axis as the photosensitive drum, and the photosensitive member may rotate according to the rotation of the process side driving unit. Further, the rotation force of the process side driving unit may be transmitted to the photosensitive member through the gear or the like without the process side driving unit being provided on the same axis as the photosensitive member.

According to a sixth aspect of the invention, in the image forming apparatus according to any one of the first to fourth aspects of the invention, the process side driving unit rotates the developing roller as the rotational driving subject, and the main body side driving unit freely advances or retreats between a joint location where the main body side driving unit joints with the process side driving unit provided in the process unit, and a non-joint location where the main body side driving unit does not joint with the process side driving unit, and attachment and detachment of the process unit with respect to the image forming apparatus are not hindered, at a location that advances to the process unit existing at the process mounting location in the image forming apparatus. The image forming apparatus further includes an advancing action unit that, when the process unit exists at the process mounting location, advances the main body side driving unit to the joint location.

According to this configuration, the main body side driving unit advances to the process side driving unit such that they joint with each other. However, when the process unit does not exist at the process mounting location being the mounting location with respect to the image forming apparatus, the main body side driving unit does not advance up to the joint location where the main body side driving unit joints with the process side driving unit, such that they do not joint with each other. Accordingly, it can be prevented that the process unit is normally not mounted on the image forming apparatus, the main body side driving unit rotates in a state in which the joint between the main body side driving unit and the process side driving unit is unstable, and the main body side driving unit or the process side driving unit, and the process unit or the image forming apparatus are damaged.

According to a seventh aspect of the invention, in the image forming apparatus according to any one of the first to sixth aspects of the invention, the transmission permission unit is provided in the developing cartridge that forms the process unit. When the process unit in which the developing cartridge is not mounted is mounted at the mounting location with respect to the image forming apparatus, since the connection switching unit enters the non-transmission state, the damage can be more surely prevented.

According to an eighth aspect of the invention, in the image forming apparatus according to the first aspect of the invention, the transmission permission unit is a protruding portion that is provided integrally with a rotation shaft of the developing roller, the process side driving unit rotates the developing roller as the rotational driving subject, the main body side driving unit freely advances or retreats between a joint location where the main body side driving unit joints with the process side driving unit provided in the process unit, and a non-joint location where the main body side driving unit does not joint with the process side driving unit, and attachment and detachment of the process unit with respect to the image forming apparatus are not hindered, at a location that advances to the process unit existing at the process mounting location in the image forming apparatus, the connection switching unit enters the transmission state, when the protruding portion moves to a specific location having been determined that the process unit exists at the process mounting location, and the image forming apparatus further includes an advancing action unit that advances the main body side driving unit to the joint location, when the protruding portion moves to the specific location.

According to this configuration, similar to the image forming apparatus according to the seventh aspect of the invention, when the process unit in which the developing cartridge is not mounted is mounted at the mounting location with respect to the image forming apparatus, since the connection switching unit enters the non-transmission state, the damage can be more surely prevented. In particular, since the rotation shaft of the developing roller is used as the transmission permission unit, the developing cartridge can be constructed with a simplified structure and at the low cost without providing a separate transmission permission unit. In this case, the rotation shaft may be used as the transmission permission unit, or the rotation shaft may be used as the transmission permission unit in a state in which the rotation shaft is covered by a cover member such as a collar, in order to protect the rotation shaft.

According to a ninth aspect of the invention, there is provided a developing cartridge that is attached to or detached from a photosensitive member cartridge having a photosensitive member on which an electrostatic latent image is formed, the developing cartridge forming a process unit attachable to or detachable from an image forming apparatus when the developing cartridge is mounted on the photosensitive drum cartridge, the developing cartridge having a developing roller for supplying a developer to the photosensitive member. The developing cartridge includes a transmission permission unit that transmits a rotational driving force generated by a driving source included in the image forming apparatus to a main body side driving unit provided in the image forming apparatus to rotate a rotational driving subject in the process unit, when the process unit exists at a mounting location with respect to the image forming apparatus.

According to this configuration, it can be prevented that in a state in which the process unit including the developing cartridge is not mounted on the image forming apparatus at a correct location, in the image forming apparatus, the rotation driving force of the driving source is not transmitted to the main body side driving unit. Therefore, similar to the first aspect of the invention, the damage can be surely prevented.

According to a tenth aspect of the invention, there is provided a process unit that includes a photosensitive member cartridge having a photosensitive drum on which an electrostatic latent image is formed, and a developing cartridge having a developing roller for supplying a developer to the photosensitive member and being attachable to or detachable from the photosensitive member cartridge, the process unit being attachable to or detachable from an image forming apparatus. The process unit includes the developing cartridge according to claim 9 as the developing cartridge.

If the process unit is used in the image forming apparatus, similar to the first aspect of the invention, it is possible to effectively prevent the damage.

Hereinafter, aspects of the invention will be described in detail with reference to the accompanying drawings.

[First Aspect]

FIG. 1 is a side cross-sectional view schematically illustrating a laser printer as an image forming apparatus.

As shown in FIG. 1, a laser printer 1 includes a feeder unit 3 that feeds a sheet P, a process unit 4 that forms a developing image being a visible image on the fed sheet P, a fixing unit 100 that fixes the developing image formed on the sheet P, and a discharge unit 200 that discharges the sheet P having passed through the fixing unit 100, which are provided in a main body casing 2 having a top cover 18, a front cover 16, and a rear cover 60. Incidentally, in the present aspect, the rear cover 60 side will be referred to as a "rear side", and the a front cover 16 side will be referred to as a "front side".

The feeder unit 3 includes a sheet feed cassette 6, sheet feed rollers 7 and 8 that are provided on an end at a front end side (front side) of the sheet P stacked in the sheet feed cassette 6 in a conveyance direction, and a sheet feed pad 9. Further, in the feeder unit 3, a conveyance path of the sheet P, that is, a sheet feed path, 10 through which the sheet P fed from the sheet feed cassette 6 is reversed and conveyed to a lower portion of the process unit 4, is formed. The feeder unit 3 further includes a pair of register rollers 12 that face the sheet feed path 10. Further, in the sheet feed path 10, in addition to the sheet P in the sheet feed cassette 6, a sheet P that is manually fed and set is also fed. In any one of two cases, the sheet is stopped by the pair of register rollers 12, and then fed to the process unit 4 according to an image forming timing in the process unit 4.

The sheet feed cassette 6 is mounted on lower portions of the process unit 4 and the fixing unit 100 to be inserted/removed into/from a front side of the main body casing 2. In the sheet feed cassette 6, a sheet pressing plate 13 and a spring 14 are provided. An end of the sheet pressing plate 13 that is away from the sheet feed roller 7 is pivotally supported, and an end of the sheet pressing plate 13 that is closer to the sheet feed roller 7 is movable in an upward-downward direction. Further, the spring 14 is provided such that it urges the sheet pressing plate 13 in an upward direction at a back surface side of the end of the sheet pressing plate 13 closer to the sheet feed roller 7.

The sheet feed roller 8 and the sheet feed pad 9 are disposed to be opposite to each other. In addition, the sheet feed pad 9 is urged toward the sheet feed roller 8 by means of a spring 15 that is provided on a back side of the sheet feed pad 9. When the sheet pressing plate 13 receives a power upward from the spring 14 at the back surface side of the sheet pressing plate 13, the uppermost sheet P of the sheets P that are stacked on the sheet pressing plate 13 comes into contact with the sheet feed roller 7 to be pressed. In addition, the uppermost sheet P starts to be conveyed by the sheet feed roller 7 to be then interposed between the sheet feed roller 8 and the sheet feed pad 9. Then, when the sheet feed roller 8 rotates, the uppermost sheet P is fed to the sheet feed path 10 while being surely separated from the other sheets P by the sheet feed roller 8 and the sheet feed pad 9.

Then, the sheet P that is fed to the sheet feed path 10 is conveyed to the register roller pair 12 that is deposed on an upper side of the sheet feed roller 7. Then, the sheet P is registered by the register roller pair 12, and then conveyed between the photosensitive member 37 and the transfer roller 39.

A scanner unit 26 that is provided on a top portion of the process unit 4 includes a laser emitting unit (not shown), a polygon mirror 29 that is driven to rotate at high speed, a first scanning lens 30 (fθ lens), a second scanning lens 31 (cylindrical lens), reflecting mirrors 32 and 33, and the like. In addition, a laser beam that is emitted from the laser emitting portion and modulated on the basis of image information, indicated by two-dot chain lines, passes through the polygon mirror 29, the first scanning lens 30, the reflecting mirror 32, the second scanning lens 31, and the reflecting mirror 33 in this order, and scans a surface of a photosensitive drum 37 in the process unit 4 to be exposed.

The process unit 4 is constructed such that it is attached to and detached from the main body casing 2 of the laser printer 1. The process unit 4 includes a photosensitive member cartridge 35 and a developing cartridge 36. In addition, the photosensitive member cartridge 35 includes the photosensitive drum 37, a charger 38, and a transfer roller 39. Further, the developing cartridge 36 is constructed such that it can be attached to and detached from the photosensitive member cartridge 35. The developing cartridge 36 includes a developing roller 40, a layer-thickness regulating plate 41, a supply roller 42, and a hopper 43.

The developer roller 40 of the developing cartridge 36 includes a metallic developing roller shaft 40*a*, and a roller that is a conductive rubber material coated on the developing roller shaft 40*a*, and it is driven to rotate in a counterclockwise direction.

The layer-thickness regulating plate 41 is provided in the vicinity of the developing roller 40, and has a plate main body that is made of a metallic plate spring member. At a tip end of the plate main body, a pressing portion that is made of insulating silicon rubber and has a cross section with a semicircular shape is provided. In addition, the pressing portion is constructed to come into contact with a top surface of the developing roller 40 in a pressurized state by means of an elastic force of the plate main body.

Further, a developer in the hopper 43 is stirred, when an agitator 45 supported by the rotation shaft 44 rotates in a clockwise direction, and then discharged through a supply opening opened in a side portion of the hopper 43. At a lateral location of the supply opening 46, the supply roller 42 is rotatably disposed, and the developing roller 40 is disposed opposite to the supply roller 42 to rotate. The supply roller 42 and the developing roller 40 come into contact with each other in a predetermined compressed state.

In addition, the developer discharged from the supply opening 46 is supplied to the supply roller 42, and supplied to the developing roller according to the rotation of the supply roller 42. At this time, the developer is frictionally charged with a positive polarity between the supply roller 42 and the developing roller 40. In addition, when the developer roller 40 rotates, the developer supplied to the top surface of the developing roller 40 moves between the pressing portion of the layer-thickness regulating plate 41 and the developing roller 40, and then carried on the developing roller 40 as a thin layer with a predetermined thickness.

The photosensitive drum 37 of the photosensitive member cartridge 35 has a drum shaft 37*a*, and a drum main body (not shown) that is coated on the drum shaft 37*a*. At the lateral location of the developing roller 40, the photosensitive drum 37 is supported to rotate in a clockwise direction in a state in which the photosensitive drum 37 is opposite to the developing roller 40. Further, on the surface of the drum main body, a positively chargeable photosensitive layer formed of polycarbonate or the like is formed.

On an upper side of a leftward inclined direction of the photosensitive drum 37, the charger 38 is disposed to be opposite to the photosensitive drum 37 at a predetermined interval from the photosensitive drum 37. The charger 38 is a scorotron charger for positive charging and generates corona discharge from a charging wire made of tungsten. The charger 38 uniformly charges a surface of the photosensitive drum 37 with a positive polarity.

Under the photosensitive drum 37, the transfer roller 39 is disposed to be opposite to the photosensitive drum 37, and supported to rotate in a counterclockwise direction. The transfer roller 39 includes a metallic roller shaft, and a roller that is made of a conductive rubber material coated on the roller shaft. In addition, when the developing image is transferred to the sheet P, a transfer bias is applied to the transfer roller 39.

When the photosensitive drum 37 rotates, first, the surface of the photosensitive drum 37 is uniformly charged with a positive polarity by means of the charger 38. Then, the surface of the photosensitive drum 37 is exposed by scanning a laser beam from the scanner unit 26, thereby forming an electrostatic latent image. In addition, when the photosensitive drum 37 and the developing roller 40 rotate, the developer that is carried on the developing roller 40 and charged with a positive polarity is supplied to the photosensitive drum 37 by means of the developing bias applied to the developing roller 40. Specifically, the developer is supplied to an exposed portion of a surface of the photosensitive drum 37 which is exposed by a laser beam and whose potential is lowered), that is, a portion of an electrostatic latent image. In addition, the developer image is carried on the photosensitive drum 37.

Then, the developer image that is carried on the surface of the photosensitive member drum 37 is transferred to the sheet P by means of the transfer bias applied to the transfer roller 39 while the sheet P passes between the photosensitive drum 37 and the transfer roller 39.

The fixing unit 100 is disposed to be closer to a conveyance direction downstream side than the process unit 4 on an upper portion of the sheet cassette 6 and at a lateral side of the process unit 4. The fixing unit 100 includes a heating roller 110 that has a heater composed of, for example, a halogen lamp, and a pressurizing roller 120 that is disposed to be opposite to the heating roller 110 and presses on a surface of the heating roller 110.

The pressurizing roller 120 is formed by rolling a PTFE (polytetrafluoroethylene) film on a surface of an elastic body of a roller shaft (not shown) made of silicon rubber or the like. In addition, the pressurizing roller 120 is driven by the heating roller 110 in a state in which it presses on the heating roller 110.

The fixing unit 100 thermally fixes the developer image transferred to the sheet P by the process unit 4 on the sheet P while the sheet P is conveyed with the sheet P interposed between the heating roller 110 and the pressurizing roller 120. Then, the sheet p is sent to the discharge path 50, and then discharged on the sheet discharge tray 52 through the pair of discharge rollers 53 and 55.

Figure 2:
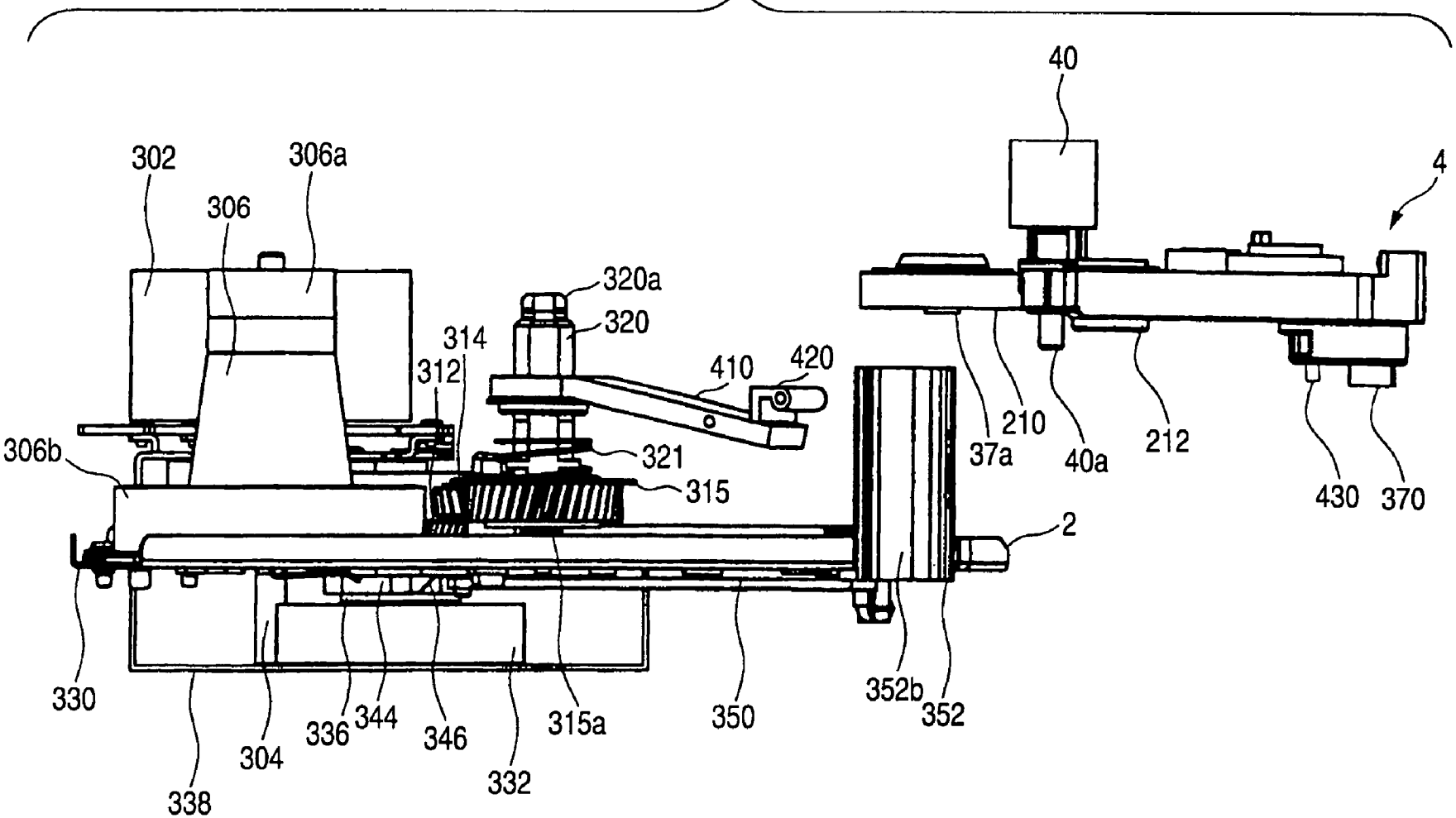
FIG. 2 is a plan view of the laser printer.
Figure 3:
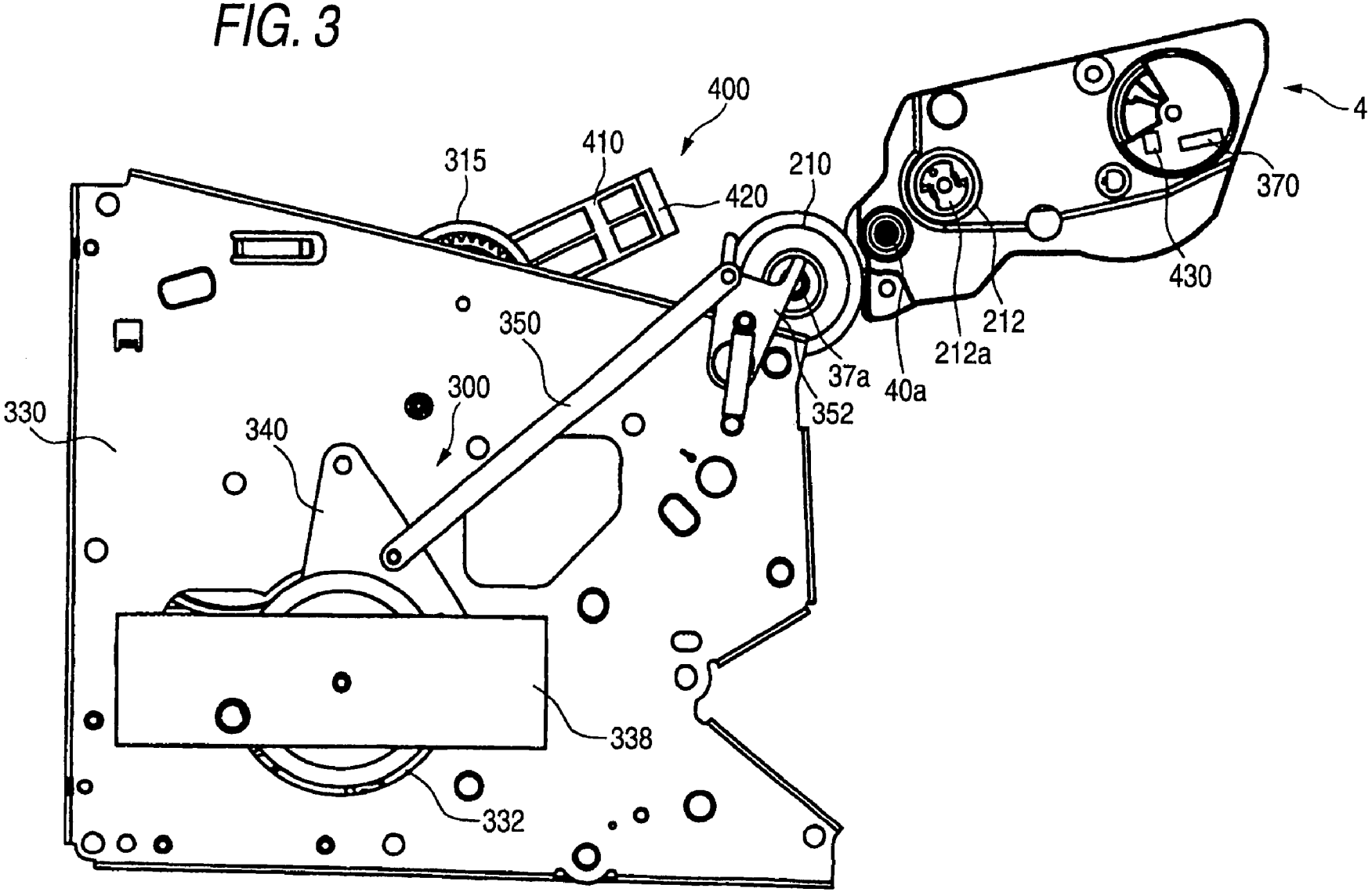
FIG. 3 is a side view of the laser printer.
Figure 10:
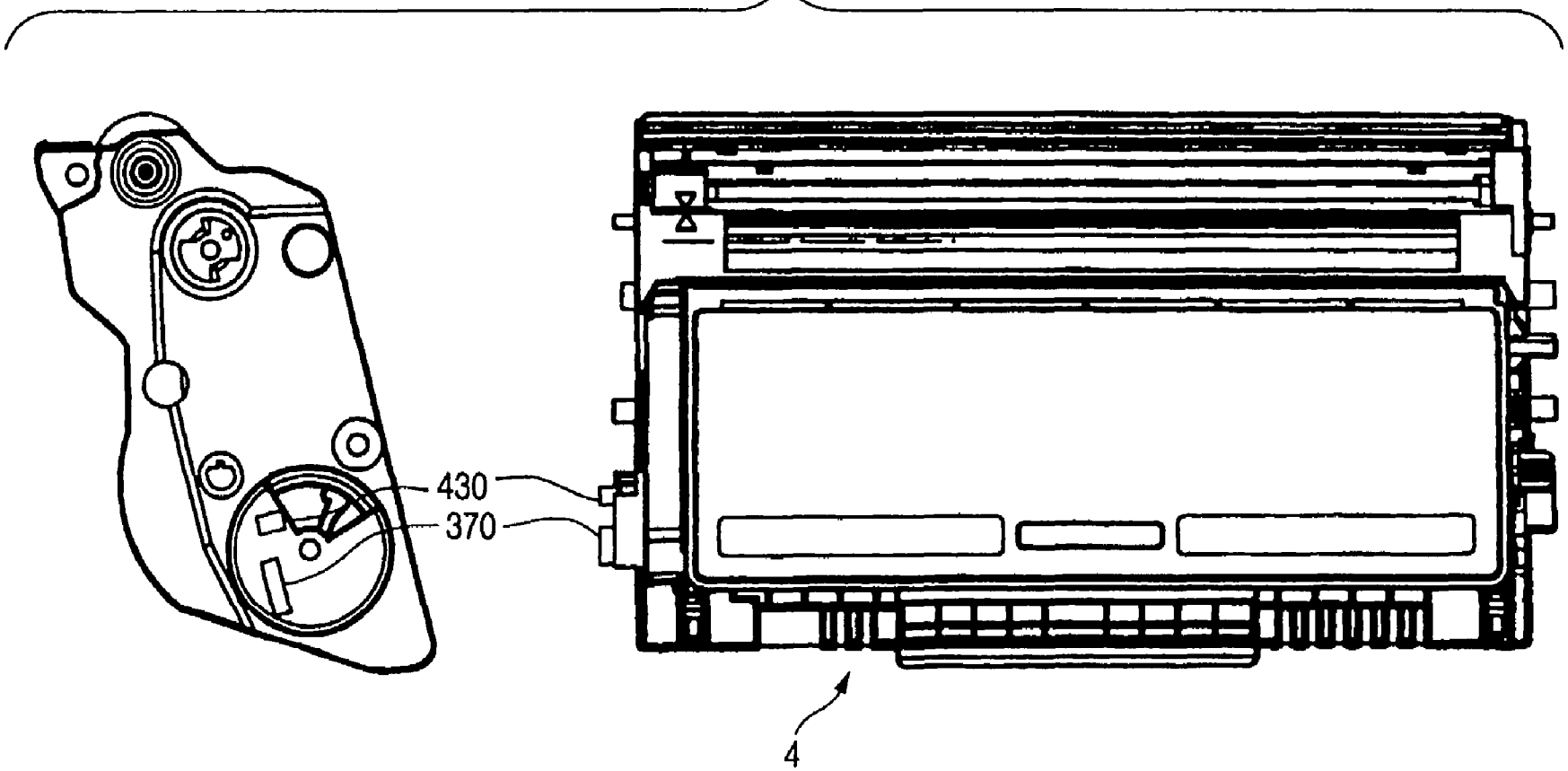
FIG. 10 is a view illustrating an entire structure of a process unit.

FIG. 2 is a plan view illustrating portions related to attachment and detachment with respect to the main body casing 2 and the process unit 4. FIG. 3 is a side view corresponding to FIG. 2. Further, an overall configuration of the process unit 4 is shown in FIG. 10.

As shown in FIGS. 2 and 3, in the process unit 4, a drum gear 210 for rotating the photosensitive drum 37 (see FIG. 1) and a developing coupling 212 for rotating the developing roller 40 (see FIGS. 1 and 2) are provided. The drum gear 210 is provided at a shaft end of the drum shaft 37*a* that is included in the photosensitive member cartridge 35 (see FIG. 1) of the process unit 4. When the drum gear 210 rotates, the photosensitive drum 37 rotates. Further, the developing coupling 212 is constructed such that it is provided in the developing cartridge 36 (see FIG. 1) of the process unit 4 and transmits a rotation force to the developing roller 4.

As shown in FIG. 2, on the side of the main body casing 2, a drum driving gear 306 that rotates when a rotation driving force of the motor 302 is transmitted, and a developing driving gear 315 are provided. Further, on a developing driving gear supporting shaft 315*a* that rotatably supports the developing driving gear 315, a main body coupling 320 that can be coupled to the developing coupling 212 is provided in a state in which it cannot not rotate relative to the developing driving gear 315. Further, on the developing driving gear supporting shaft 315*a*, the main body coupling 320 can advance to and retreat from the developing coupling 212. In addition, the main body coupling 320 advances to the developing coupling 212 to be thus coupled to the developing coupling 212. Further, advancing and retreating operations of the main body coupling 320 will be described in detail later.

The drum driving gear 306 has a drum gear portion 306*a* that is engaged with the drum gear 210, and an internal gear portion 306*b* that is engaged with an internal driving gear 308 (see FIG. 4) to be described in detail below. The drum driving gear 306 receives a rotation driving force of the motor 302 (see FIGS. 2 and 4) through the internal driving gear 308, and transmits a rotation force to the drum gear 210. Further, the developing driving gear 315 also receives a rotation force through the internal driving gear 308, and the main body coupling 320 rotates according to the rotation of the internal driving gear 308.

In the present aspect, when the process unit 4 does not exist at a mounting location with respect to the main body casing 2, a rotation driving force of the motor 302 is not transmitted to the drum driving gear 306 and the developing driving gear 315. Specifically, in the laser printer 1, a transmission mechanism 300 (see FIG. 3) that switches whether to transmit the rotation driving force of the motor 302 to the side of the drum driving gear 306 or not is provided. When the process unit 4 does not exist at the mounting location with respect to the main body casing 2, the transmission mechanism 300 enters a state in which the transmission mechanism 300 does not transmit the rotation driving force.

Further, when the process unit 4 does not exist at the mounting location with respect to the main body casing 2, the main body coupling 320 does not come into contact with the developing coupling 212. Specifically, in the laser printer 1, an advancing mechanism 400 (see FIG. 3) for advancing the main body coupling 320 to the side of the developing coupling 212 is provided. When the process unit 4 does not exist at the mounting location with respect to the main body casing 2, the advancing mechanism 400 does not advance the main body coupling 320 up to a location where the main body coupling 320 is coupled to the developing coupling 212.

Hereinafter, structures and operations of the transmission mechanism 300 and the advancing mechanism 400 will be described in detail.

Figure 4:
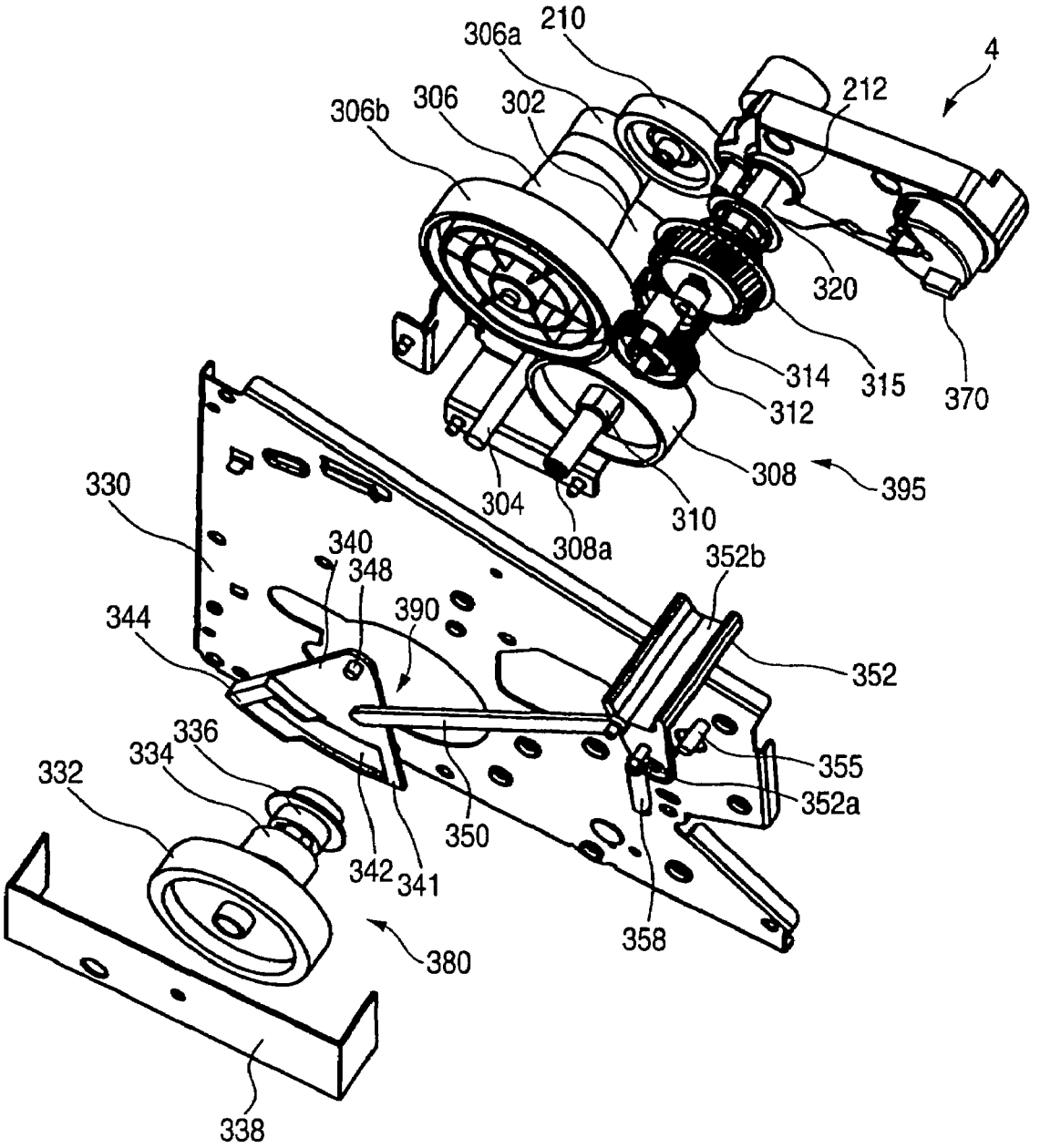
FIG. 4 is an exploded view illustrating a transmission mechanism.
Figure 5A:
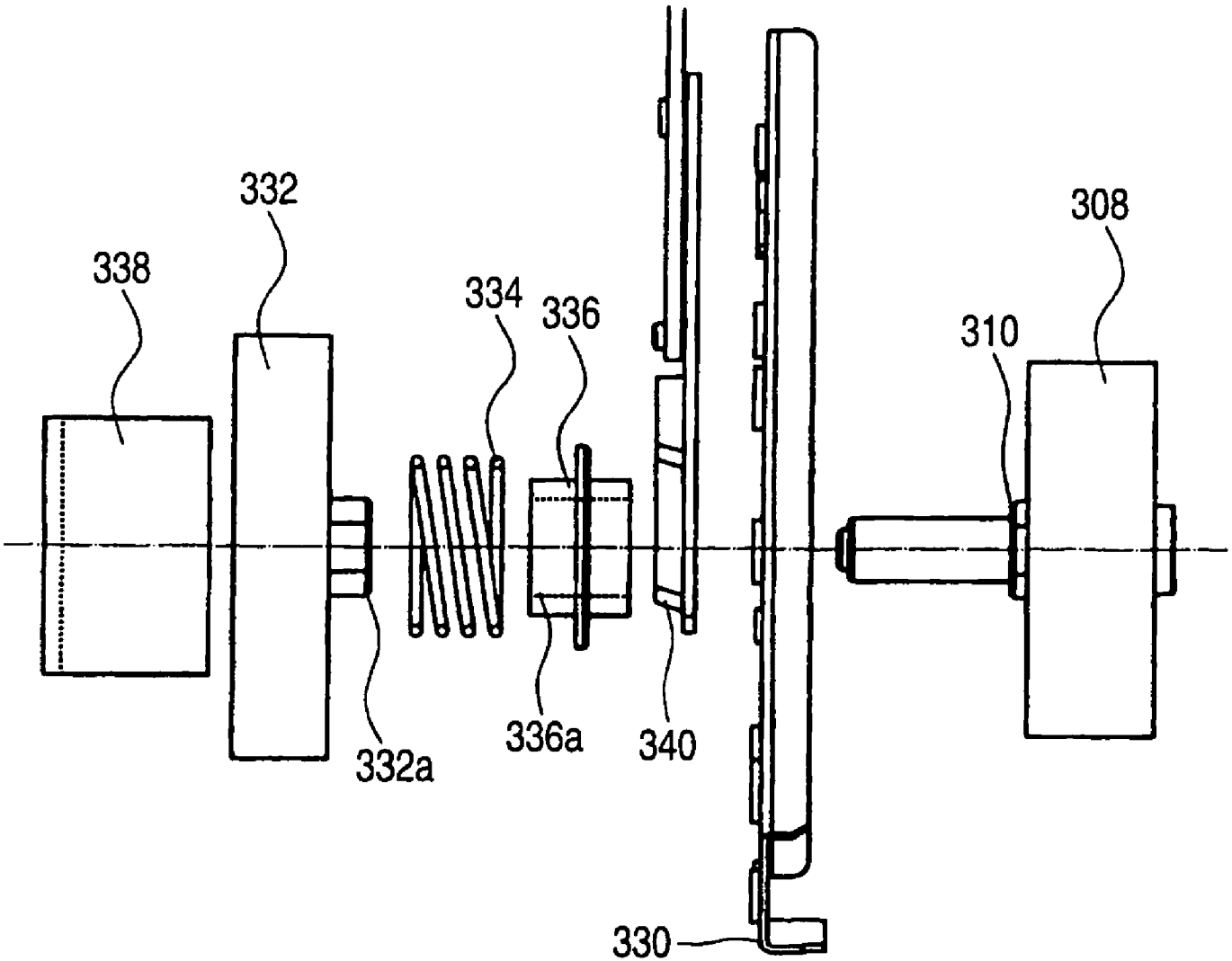
FIGS. 5A to 5C are schematic views illustrating a transmission portion.
Figure 5C:
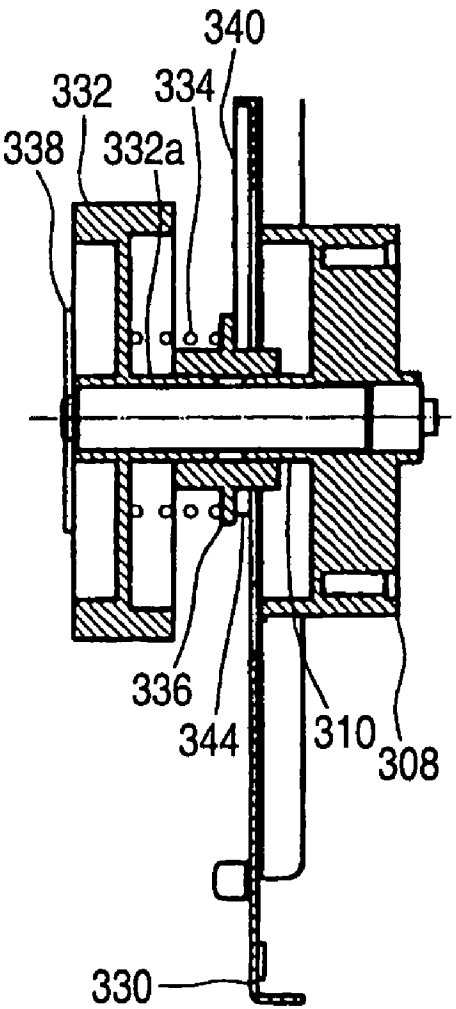
Figure 5B:
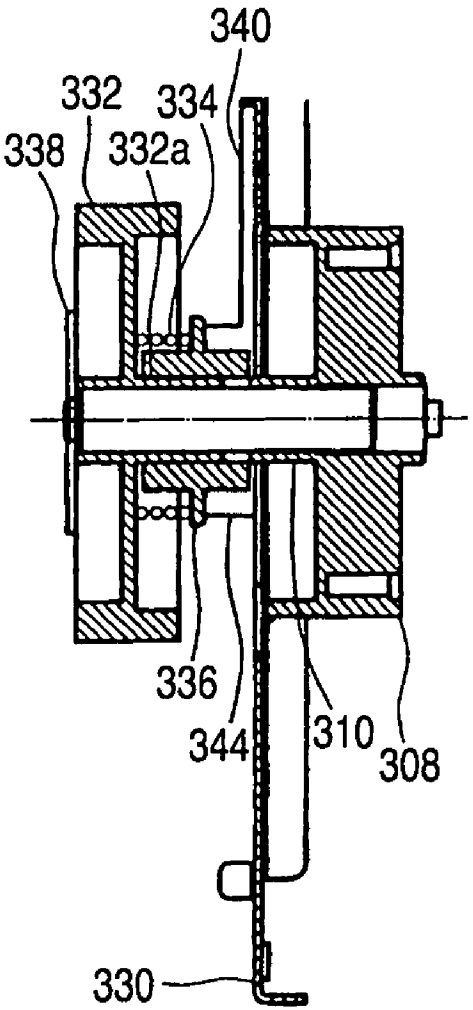
Figure 6:
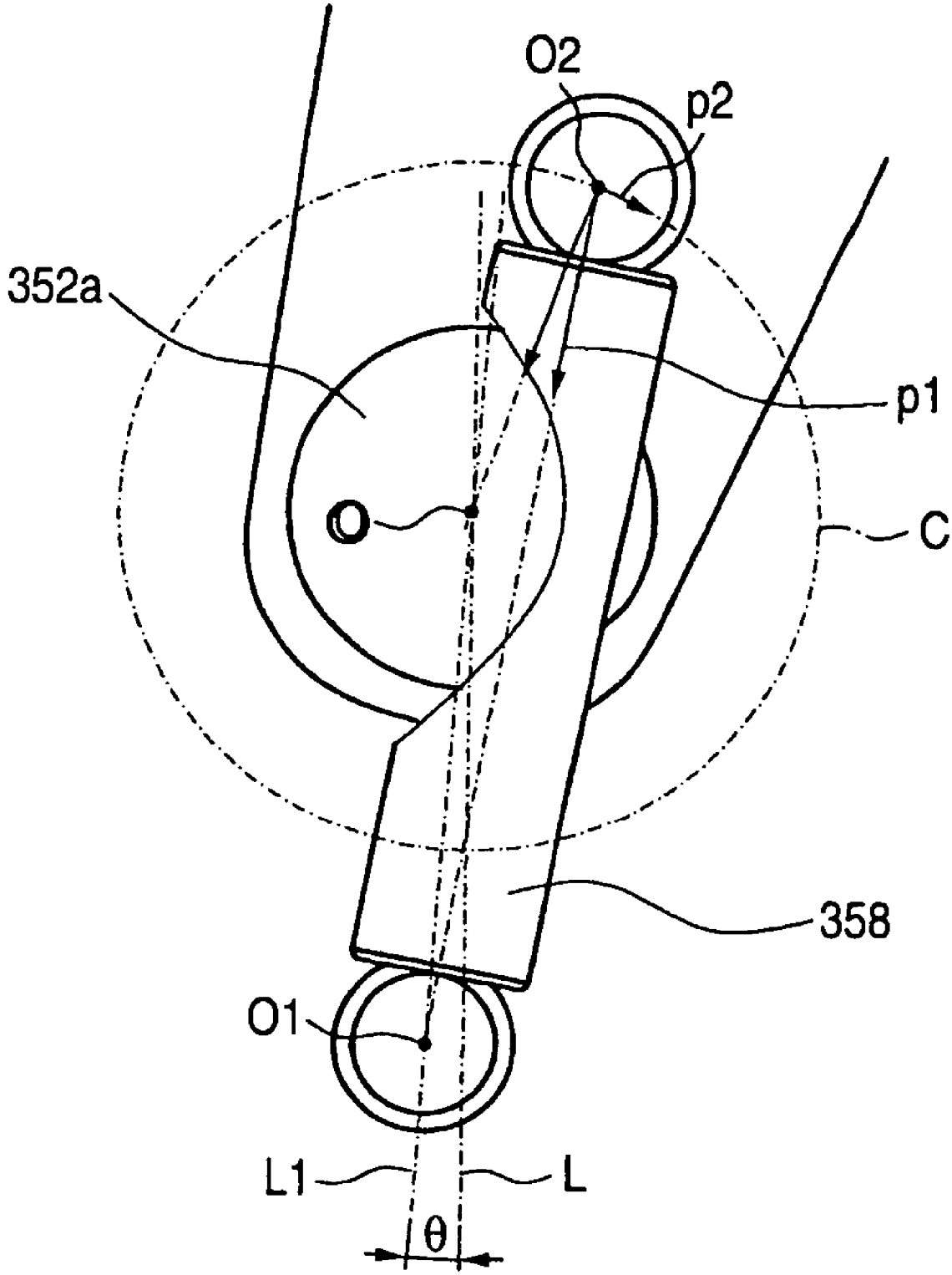
FIG. 6 is a schematic view illustrating the operation of a switching lever.

First, a structure of the transmission mechanism 300 will be described with reference to FIGS. 4 to 6. FIG. 4 is an exploded view of the transmission mechanism 300, and FIGS. 5A to 5C are schematic views illustrating a transmission portion 380 in FIG. 4. FIG. 5A is an exploded view of the transmission portion 380, FIG. 5B is a view illustrating a state in which an external driving gear 332 and an inner driving gear 308 are not connected to each other, and FIG. 5C is a view illustrating a state in which the external driving gear 332 and the internal driving gear 308 are connected to each other. FIG. 6 is a schematic view illustrating an operation of a switching lever 352 of FIG. 4. In FIG. 4, the advancing mechanism 400 is not shown.

As shown in FIG. 4, the transmission mechanism 300 includes a transmission portion 380, an interlocking portion 390, and a transmission gear portion 395.

The transmission gear portion 395 includes an internal driving gear 308, a lower transmission gear 312, and an upper transmission gear 314.

The internal driving gear 308 is disposed on a front side (right side in FIG. 4) of a motor gear 304 that is constructed in a gear shape and is a rotation driving shaft of the motor 302. The internal driving gear 308 is disposed such that it does not come into contact with the motor gear 304, and it is engaged with the internal gear portion 306*b* included in the above-described drum driving gear 306. In addition, the internal driving gear 308 is supported to rotate about an internal driving gear supporting shaft 308*a*. Further, at a rotation center portion of the internal driving gear 308, a pillar-shaped hexagonal key 310 constructed to engage with a joint 336 (to be described below) is integrally provided such that it cannot rotate relatively to the internal driving gear 308.

The lower transmission gear 312 and the upper transmission gear 314 are provided on a front side of the drum driving gear 306 (right side in the drawing). The lower transmission gear 312 is disposed to be engaged with the internal gear portion 306*b*, and the upper transmission gear 314 is disposed to be engaged with the lower transmission gear 312 and the developing driving gear 315. That is, when the internal driving gear 308 rotates, the drum driving gear 306 that is engaged with the internal driving gear 308 rotates, and the developing driving gear 315 also rotates through the lower transmission gear 312 and the upper transmission gear 314.

The transmission portion 380 and the interlocking portion 390 transmit the rotation driving force of the motor 302 to the internal driving gear 308. A gear plate 330 cover the motor 302 and the internal driving gear 308.

The transmission portion 380 includes an external driving gear 332, a joint spring 334, a joint 336, and a sub-gear plate 338. In addition, the external driving gear 332, the joint spring 334, and the joint 336 are rotatably supported by the internal driving gear supporting shaft 308*a* for supporting the internal driving gear 308 such that they are opposite to the internal driving gear 308 with the sub-gear plate 330 and a cam plate 340 (described later) interposed therebetween.

In addition, the external driving gear 332 is disposed to be engaged with the motor gear 304 of the motor 302. Further, on the side of the internal driving gear 308 in the rotation center portion of the external driving gear 332, a pillar-shaped hexagonal protrusion 332*a* (see FIG. 5A) is integrally provided such that it cannot rotate relative to the external driving gear 332.

The joint 336 is mounted between the external driving gear 332 and the internal driving gear 308 such that it cannot rotate relatively to the external driving gear 332 with a joint spring 334 interposed therebetween. Specifically, the joint 336 has a hexagonal recess 336*a* (see FIG. 5), and the hexagonal recess 336*a* engages with the hexagonal protrusion 332*a*.

The joint spring 334 is a compression coil spring, and it is fit on the external driving gear 332 and the joint 336 so as to insert the hexagonal protrusion 332*a* and the joint 336. In addition, by means of a spring force by the joint spring 334, the joint 336 is always urged toward the side of the internal driving gear 308.

The sub-gear plate 338 is attached to the end of the internal driving gear supporting shaft 308*a* so as to cover the external driving gear 332. As a result, the external driving gear 332 does not come off the internal driving gear supporting shaft 308*a*.

The interlocking portion 390 includes a switching lever 352, a switching lever spring 358, a cam plate 340, and a link 350. Meanwhile, on the developing cartridge 36 in the process unit 4, a protrusion-shaped process key 370 is provided.

The switching lever 352 has a U-shaped groove 352*b*, and it is supported to rotate about the switching lever supporting shaft 352*a*. When the process unit 4 is mounted on the main body casing 2, the groove 352*b* of the switching lever 352 engages with the process key 370 that is provided on the developing cartridge 36, and the switching lever 352 rotates in a mounting progressing direction of the process unit 4.

The switching lever spring 358 is formed of a coil spring, and its end is connected to a higher portion of the switching lever 352 than the switching lever supporting shaft 352*a*, and its other end is connected to the gear plate 330. In addition, the switching lever 352 is constructed such that it is pulled by the switching lever spring 358 in a vertically downward direction. Thereby, the switching lever 352 is constructed to rotate to any one of the front side and the rear side of the apparatus. Specifically, as shown in FIG. 6, a straight line L1 that connects a rotation center O of the switching lever supporting shaft 352*a* and a connection center O1 of the switching lever spring 358 at the gear plate side is inclined by a predetermined angle θ from a straight line of the vertical direction. In addition, on the switching lever 352, in a rotation direction of the switching lever 352, that is, in a tangential direction of a circle C at an intersection point between a straight line connecting the point O and a point O2 and the circle C passing the point O2 and centering on the point O, a component force p2 acts due to a tensile force p1 of the switching lever spring 358. That is, the switching lever 352 necessarily rotates. Further, in the gear plate 330, a protrusion-shaped pin 355 is provided on a front side of the switching lever 352. When the gear plate 352 falls down ahead, the switching lever 352 comes into contact with the pin 355. Accordingly, the switching lever 352 is prevented from rotating at the contact location.

The cam plate 340 has a substantially triangle shape, and a cylindrical protrusion 348 is provided in the vicinity of one top of the cam plate 340. In addition, the cam plate 340 is attached to the gear plate 330 such that the protrusion 348 is disposed at a relatively higher location than another top and the cam plate 348 rotates about the protrusion 348. On the side of the cam plate 340 that is opposite to the protrusion 348, an elongated hole portion 342 is formed. The cam plate 340 is disposed such that it inserts the internal driving gear supporting shaft 308*a* and the joint 336 into the elongated hole portion 342. Further, at a peripheral portion of the elongated hole portion 342 in the cam plate 340, on the rear side of the apparatus (left side in the drawing), a thick member 344 that has a larger thickness than peripheral portions is formed. The portions having a common thickness around the elongated hole portion 342 form a thin member 341 that is thinner than the thick member 344. In addition, the thick member 344 further includes a tapered portion 346 that is inclined to the thin member 341.

The link 350 is an elongated plate, and supports the cam plate 340 and the switching lever 352 such that they can be interlocked. In order for the link 350 to rotate about the cam plate 340, its one end is connected to the cam plate 340. Further, in order for the link 350 to rotate about the switching lever 352, the other end that is opposite to the one end connected to the cam plate 340 is connected to the switching lever 352.

Figure 7:
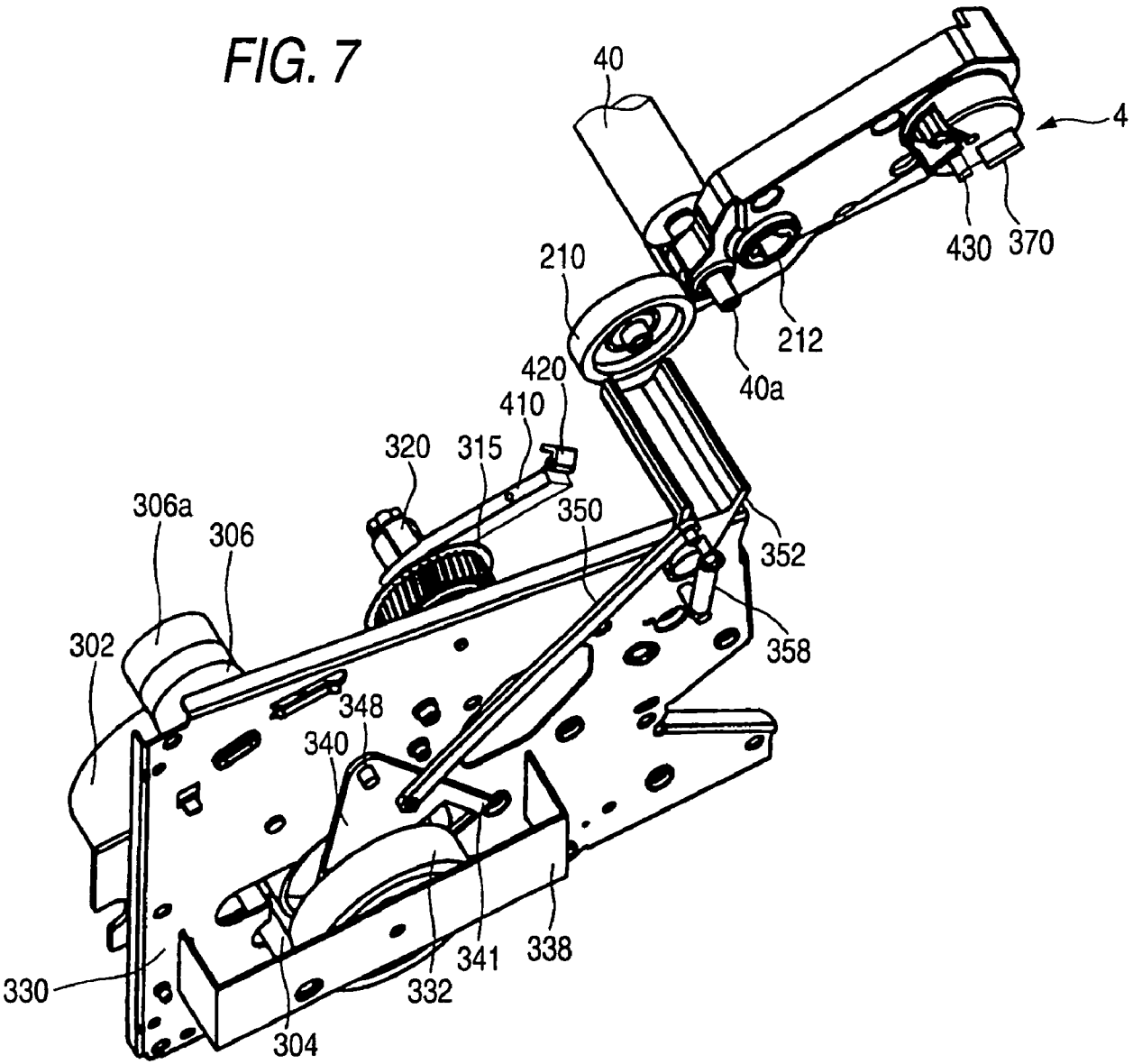
FIG. 7 is a first perspective view of the laser printer.
Figure 8:
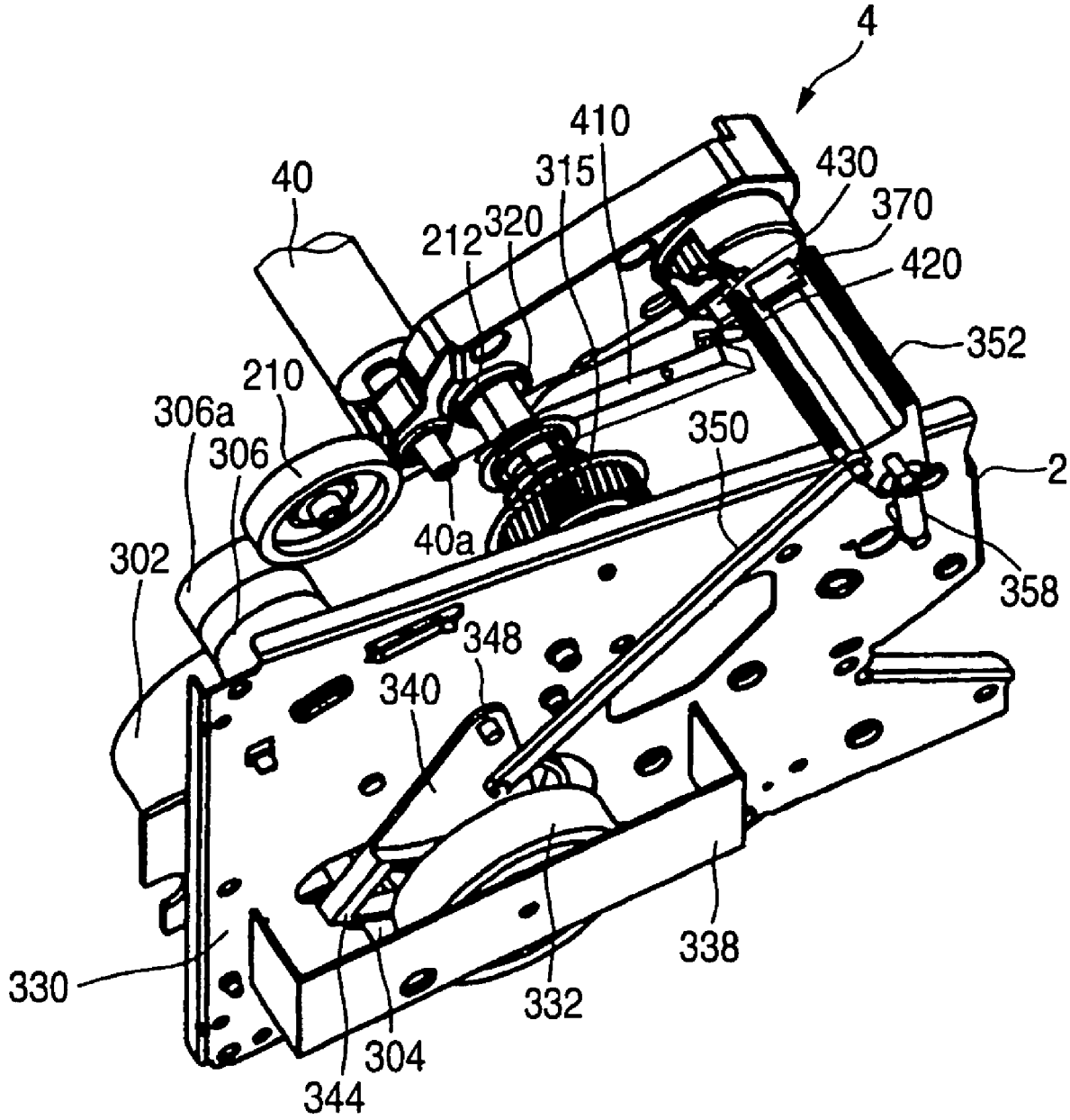
FIG. 8 is a second perspective view of the laser printer.

Now, the operation of the transmission mechanism 300 having the above-mentioned structure will be described with reference to FIGS. 5B, 5C, 7 and 8. FIG. 7 is a perspective view illustrating a state in which the process unit 4 is not mounted on the main body casing 2, and FIG. 8 is a perspective view illustrating a state in which the process unit 4 is mounted on the main body casing 2. In FIG. 8, if the process unit 4 is drawn from the main body casing 2, the switching lever 352 rotates to the front side of the apparatus while engaging with the process key 370. When the switching lever 352 rotates, the cam plate 340 also rotates in a counterclockwise direction through the link 350.

That is, as shown in FIG. 7, in a state in which the process unit 4 is not mounted on the main body casing 2, the switching lever 352 generally rotates to the front side of the apparatus, and the cam plate 340 that is connected to be interlocked through the switching lever 352 and the link 350 rotates in a counterclockwise direction.

At this time, the thick member 344 of the cam plate 340 comes into contact with the joint 336 (see FIG. 5B). In addition, the joint 336 is pressed toward the side of the external driving gear 332 by the thick member 344 and moves to the side of the external driving gear 332 against an urging force of the joint spring 334.

That is, the hexagonal recess 336*a* of the joint 336 and the hexagonal key 310 of the internal driving gear 308 are spaced apart from each other, and a rotation force of the external driving gear 332, that is, a rotation driving force of the motor 302 is not transmitted to the internal driving gear 308.

If the process unit 4 is mounted on the main body casing 2, the process key 370 of the developing cartridge 36 comes into contact with the groove 352*b* of the switch lever 352 at a predetermined location. Further, when the process unit 4 moves in a mounting progress direction, the switch lever 352 rotates in a counterclockwise direction. In addition, the cam plate 340 rotates about the protrusion 348 in a clockwise direction through the link 350.

In this case, the thick member 344 of the cam plate 340 moves to a rear side of the apparatus relative to the joint 336, and the tapered portion 346 comes into contact with the joint 336. Finally, the thin member 341 comes into contact with the joint 336. In addition, the joint 336 moves to the side of the internal driving gear 308 by means of the urging force of the joint spring 334 (see FIG. 5C).

Thereby, the joint 336 advances to the side of the internal driving gear 308, and the hexagonal recess 336*a* of the joint 336 engages with the hexagonal key 310 of the internal driving gear 308. That is, the external driving gear 332 and the internal driving gear 308 are connected to each other to be driven, and the rotation driving force of the motor 302 is transmitted to the internal driving gear 308 through the external driving gear 332. Further, a taper is formed at the end of the hexagonal key 310 or the hexagonal recess 336*a*, and they can smoothly engage with each other.

As such, when the process unit 4 exists at a mounting location with respect to the main body casing 2, the transmission portion 380 and the interlocking portion 390 transmit a rotation driving force of the motor 302 to the internal driving gear 308. In contrast, when the process unit 4 does not exist at the mounting location with respect to the main body casing 2, the transmission portion 380 and the interlocking portion 390 does not transmit a rotation driving force of the motor 302 to the internal driving gear 308.

Therefore, the following problems can be resolved. That is, when the process unit 4 does not exist at the mounting location with respect to the main body casing 2, in a state in which engagement between the drum gear portion 306*a* of the drum driving gear 306 and the drum gear 210, or coupling between the main body coupling 320 and the developing coupling 212 is incomplete, the drum driving gear 306 and the developing driving gear 315 rotate, and the drum driving gear 306, the drum gear 210, the main body coupling 320 or the developing coupling link 212, and the laser printer 1 or the process unit 4 is prevented from being damaged.

Subsequently, a structure and an operation of the advancing mechanism 400 will be described with reference to FIGS. 9A to 9C (and FIGS. 7 and 8).

The advancing mechanism 400 includes a developing side link 410, and a developing side rotating member 420.

The developing side link 410 is constructed in a substantially rectangular plate shape. The developing side link 410 is supported on a side wall (not shown) of the laser printer 1 such that it can rotate about the developing side link supporting shaft 412 provided between both ends of the developing side link 410. Further, a through hole is provided in one end of the developing side link 410. In a state in which the main body coupling 320 is inserted into the through hole of the developing side link 410, one end of the developing side link 410 at the through hole side is connected to the main body coupling 320. Specifically, on the side of the developing driving gear 315 in the main body coupling 320, a disc-shaped flange 320*b* is formed. One end of the developing side link 410 is connected to a surface of the side opposite to the developing driving gear 315 of the flange 320*b* to rotate. Further, in the vicinity of the other end side opposite to one end of the developing side link 410 where the through hole is provided, the developing side rotating member 420 is provided on the side wall (not shown) of the laser printer 1.

The developing side rotating member 420 forms a substantially L shape, and its one end is rotatably supported by the rotation supporting shaft 422. When the process unit 4 is mounted on the main body casing 2, the developing side rotating member 420 is disposed such that the abutting portion 420*a* comes into contact with the developing key 430 (see FIGS. 7 and 8) provided on the developing cartridge 36. Further, the developing side rotating member 420 rotates in a state in which it comes into contact with the developing key 430, and thus a contacting portion 420*b* at the side of the other end opposite to the one end of the developing side rotating member 420 that is supported by the rotation supporting shaft 422 comes into contact with the developing side link 410.

Meanwhile, as described above, the main body coupling 320 is constructed such that on the developing driving gear supporting shaft 315*a*, it can advance or retreat to the developing coupling 212 and couples with the developing coupling 212. Hereinafter, this point and the operation of the advancing mechanism 400 will be described with reference to FIGS. 9A to 9C.

The main body coupling 320 is constructed such that it is provided on the developing driving gear supporting shaft 315*a* and can move on the developing driving gear supporting shaft 315*a*.

Further, in the main body coupling 320, on the side of one end of the developing coupling 212, a protruding portion 320*a*, which can couple with a joint portion 212*a* of the developing coupling 212 (see FIG. 3) such that the rotation cannot be relatively made, is formed. On one end of the developing driving gear 315, the above-described flange 320*b* is formed.

Figure 9A:
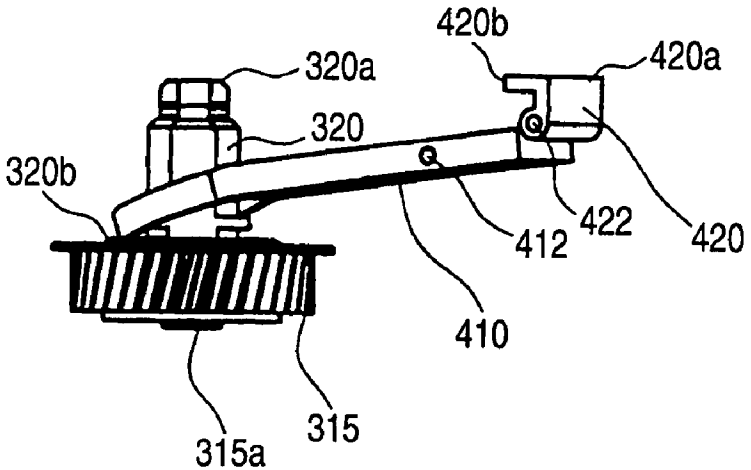
FIGS. 9A to 9C are views illustrating an advancing mechanism.
Figure 9B:
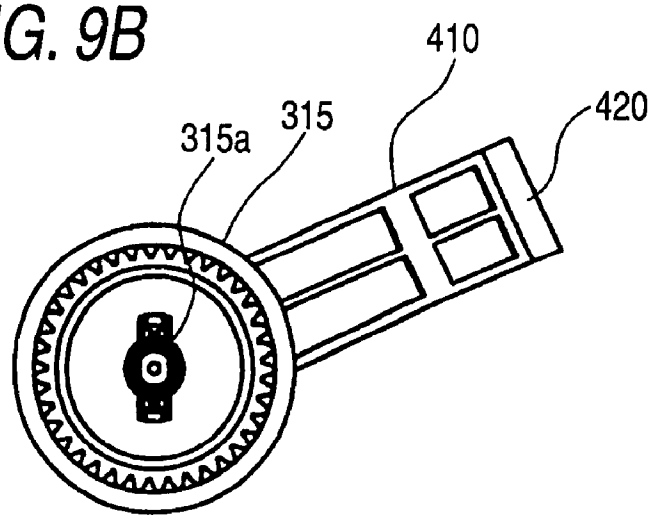
Figure 9C:
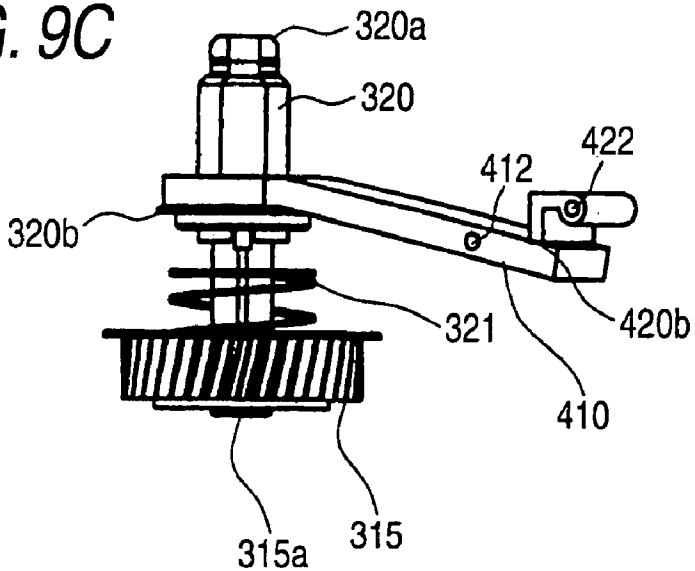

As shown in FIG. 9C, between the flange 320*b* and the developing driving gear 315, a coupling spring 321 that connects the flange 320*b* and the developing driving gear 315 is provided. In addition, by means of the coupling spring 321, the main body coupling is always pulled toward the side of the developing driving gear 315.

As shown in FIG. 9A, in a state in which the developing side driving member 420 does not rotate, that is, in a state in which the process unit 4 does not exist at a mounting location with respect to the main body casing 2 and the developing key 430 of the developing cartridge 36 (see FIGS. 7 and 8) does not come into contact with the abutting portion 420*a* of the developing side driving member 420, the main body coupling 320 moves to the side of the developing driving gear 315 by means of a tensile force by the coupling spring 321 shown in FIG. 9C.

In this case, if the process unit 4 is mounted on the main body casing 2, the developing key 430 of the developing cartridge 36 comes into contact with the abutting portion 420*a* of the developing side rotating member 420, and the developing side rotating member 420 rotates about the rotation supporting shaft 422 in a counterclockwise direction. In this case, the contact portion 420*b* of the developing side driving member 420 comes into contact with the developing side link 410, and the developing side link 410 rotates about the developing side link supporting portion 412 in a clockwise direction. Therefore, one end of the developing side link 410 where the through hole is provided advances to the side of the process unit 4, and the main body coupling 320*b* that is connected to the developing side link 410 and the flange 320*b* also advances to the side of the process unit 4, as shown in FIG. 9C.

Finally, in a state in which the process unit 4 is mounted on the mounting location with respect to the main body casing 2, the developing side link 410 rotates up to a location where the developing side link 410 can rotate, and thus the main body coupling 320 advances up to an advancing location with respect to the developing coupling 212. In addition, the protruding portion 320*a* of the main body coupling 320 couples with the joint portion 212*a* of the developing coupling 212 that is provided in the developing cartridge 36. Further, when the process unit 4 does not exist at the mounting location with respect to the main body casing 2, the main body coupling 320 does not advance up to the advancing location with respect to the developing coupling 212, and the protruding portion 320*a* and the joint portion 212*a* do not couple with each other.

Therefore, the following problems can be resolved. That is, when the process unit 4 does not exist at the mounting location with respect to the main body casing 2, since the main body coupling 320 and the developing coupling 212 do not couple with each other, in a state in which connection between the main body coupling 320 and the developing coupling 212 is incomplete, the developing driving gear 315 rotates, and the main body coupling 320 and the developing coupling 212, and the laser printer 1 or the process unit 4 are prevented from being damaged.

In the present aspect, when the rotation driving subject is the photosensitive drum 37, the drum driving gear 306 corresponds to a main body driving unit, and the drum gear 210 corresponds to a process side driving unit. When the rotation driving subject is the developing roller 40, the main body coupling 320 corresponds to a main body side driving unit, and the developing coupling 212 corresponds to a process side driving unit. Further, the motor 302 corresponds to a driving source, the transmission mechanism 300 corresponds to a connection switching unit, the process key 370 corresponds to a transmission permission unit, the joint 336 and the joint spring 334 correspond to a mechanical clutch, the interlocking portion 390 corresponds to a moving action unit, and the advancing mechanism 400 corresponds to an advancing action unit.

As described above, in the laser printer 1 according to the present aspect, it is possible to surely prevent the laser printer from being damaged.

Further, in the present aspect, in order to transmit or stop the rotation driving force of the motor 302, mechanical components, such as the joint 336, the joint spring 334, and the interlocking portion 390, are used. Therefore, it is possible to surely prevent the above-described damage with the low cost, without using a complicated circuit or an electronic component.

[Second Aspect]

Next, a laser printer 1 according to a second aspect of the invention will be described. A structure of the laser printer 1 according to the second aspect is not shown in the drawing, and the different between the laser printer 1 according to the first aspect and the laser printer according to the second aspect will be described.

First, in the transmission mechanism 300, in stead of the joint 336, the joint spring 334, and the interlocking portion 390 operating as the mechanical clutch, an electromagnetic clutch is used. When the power is supplied, the electromagnetic clutch connects the external driving gear 332 and the internal driving gear, and when the power is not supplied, the electronic magnetic clutch does not connect the external driving gear 332 and the internal driving gear.

Further, in the main body casing 2, a sensor is provided for detecting whether the process unit 4 exists at a mounting location with respect to the main body casing 2. The sensor is, for example, an optical sensor. When the process unit 4 exists at the mounting location with respect to the main body casing 2, the sensor is provided at a location where an optical path in the sensor is intercepted by the process key 370 included in the developing cartridge 36. In addition, if the optical path in the sensor is intercepted, the sensor outputs a signal.

In addition, the electromagnetic clutch is supplied with the power or not supplied with the power depending on whether the signal is outputted from the sensor. That is, depending on whether the process unit 4 exists at the mounting location with respect to the main body casing 2, a state of the transmission portion 380 is switched between a state in which the transmission portion 380 transmits the rotation driving force and a state in which the transmission portion 380 does not transmit the rotation driving force. Further, as the sensor, a laser sensor or a proximity sensor may be used. Further, instead of the sensor, a switch may be used. When the switch is used instead of the sensor, if the process unit 4 is mounted at the mounting location with respect to the main body casing 2, the switch can be constructed such that the process key 370 presses on the switch.

Figure 11:
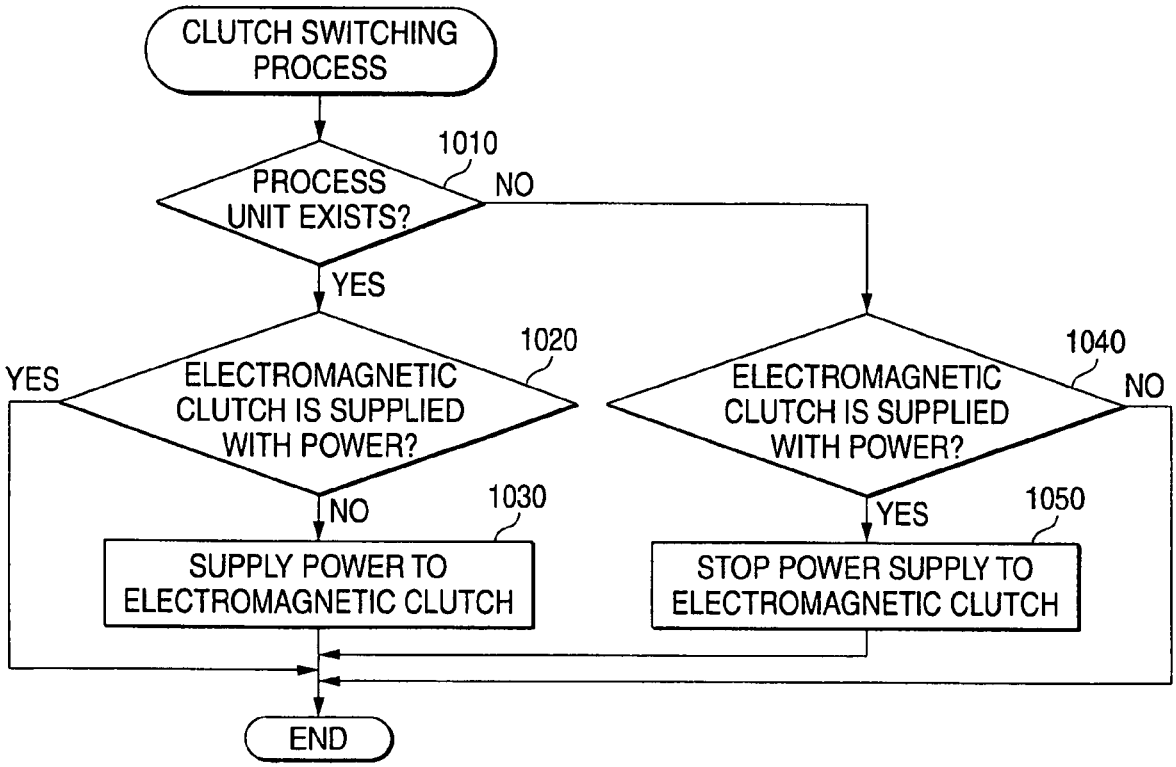
FIG. 11 is a flowchart illustrating a flow of a clutch switching process executed by a CPU of the laser printer.

Next, a clutch switching process executed by a CPU (not shown) that is included in the laser printer 1 according to the second aspect will be described with reference to a flowchart of FIG. 11. The clutch switching process is performed per predetermined time T.

In the clutch switching process, first, it is determined on the basis of the output result of the sensor whether the process unit 4 exists at the mounting location with respect to the main body casing 2 (S1010) When it is determined that the process unit 4 exists at the mounting location with respect to the main body casing 2 (S1010: YES), it is determined whether the electromagnetic clutch is supplied with a power (S1020). Then, when it is determined that the electromagnetic clutch is not supplied with the power (S1020: NO), the electromagnetic clutch is supplied with the power (S1030), and the external driving gear 332 and the internal driving gear 398 are connected to each other. Meanwhile, in step S1020, when it is determined that the electromagnetic clutch is supplied with the power (S1020: YES), all processes until now are completed.

Further, in step S1010, when it is determined that the process unit 4 does not exist at the mounting location with respect to the main body casing 2 (S1010: NO), similar to the case of being determined as YES in step S1010, it is determined that the electromagnetic clutch is supplied with a power or not (S1040). Then, when it is determined that the electromagnetic clutch is supplied with the power (S1040: YES), the electromagnetic clutch is made not to be supplied with the power (S1050), and the connection state between the external driving gear 332 and the internal driving gear 308 is released. Meanwhile, in step S1040, when it is determined that the electromagnetic clutch is not supplied with the power, all processes up to here are completed.

In the laser printer 1 according to the second aspect, it is not necessary to provide the mechanism like the interlocking portion 390 installed in the laser printer 1 according to the first aspect. Therefore, the structure of the laser printer 1 is simplified. When the electromagnetic clutch is arranged, a degree of freedom in arrangement is improved. Therefore, it is possible to achieve a laser printer having a structure in which design and installation are easy.

Further, in the present aspect, the process of S1010 corresponds to a determination unit, and the processes of S1020 to S1050 correspond to a switching control unit.

Although the aspects of the invention have been described, the invention is not limited thereto. Various modification and changes can be made without departing from the scope and spirit of the invention.

For example, in the above-described aspects, the developing roller shaft 40*a* may be used as the process key 370. In this case, the developing roller shaft 40*a* may be used as it is, or in order to protect the developing roller shaft 40*a*, the developing roller shaft 40*a* is used, in a state in which it is covered by a cover member, such as a collar.

Further, in the process unit 4, instead of the process key 370, a structure like a groove may be provided. In this case, on the side of the main body casing 2, a protrusion engaging with the groove may be provided. In addition, in the process unit, if the structure or the shape of the protrusion is changed according to a kind thereof, a different kind of a process unit 4 can be prevented from being mounted.

Further, in the above-described aspects, in the transmission mechanism 300 that has a function of moving the joint 336 onto the internal driving gear supporting shaft 308*a*, the switch lever 352 and the cam plate 340 rotate to be displaced. However, another structure may be considered. For example, a member, which comes into contact with the process key 370 and linearly moves in a mounting progress direction of the process unit 4, may be provided. At this time, similar to the cam plate 340, an elongated portion and a thick member or a thin member are provided in the member, and the joint 336 is inserted into the elongated portion. In this case, when the member linearly moves, the joint 336 can be made to move the top portion of the internal driving gear supporting shaft 308*a*. That is, it possible to achieve the same effect as the above-described aspect in which the cam plate 340 or the like is provided.

Further, in the above-described aspects, the main body coupling 320 is constructed such that it can advance and retreat on the developing driving gear supporting shaft 315*a* to couple with the developing coupling 212. However, the main body coupling 320 may be constructed such that the main body coupling 212 can rotate between the location at which it couples with the developing coupling 212, and the location at which it does not couple with the developing coupling 212 and does not hinder the mounting of the process unit 4.

What is claimed is:

1. An image forming apparatus comprising:

a process unit being attachable to and detachable from the image forming apparatus and including a developing roller for supplying a developer to a photosensitive member;

a driving source that generates a rotation driving force;

a first driving unit that rotates when the rotation driving force generated by the driving source is transmitted; and a connection switching unit that switches between a transmission state in which the rotation driving force generated by the driving source is transmitted to the first driving unit and a non-transmission state in which the rotation driving force generated by the driving source is not transmitted to the first driving unit, wherein the process unit includes:

a transmission permission unit that switches a state of the connection switching unit into the transmission state, when the process unit exists at a process mounting location with respect to the image forming apparatus; and a second driving unit that couples with the first driving unit when the process unit exists at the process mounting location and rotates a rotation driving subject in the process unit by a rotation force of the first driving unit.

2. The image forming apparatus according to claim 1, wherein the transmission permission unit includes a protruding portion that protrudes from the process unit, and the connection switching unit includes:

a mechanical clutch that is movable to a connection location connecting the driving source and the first driving unit to each other and a separation location separating the driving source and the first driving unit from each other, between the driving source and the first driving unit; and a moving action unit that, when the process unit exists at the process mounting location, comes into contact with the protruding portion to be displaced, and moves the mechanical clutch from the separation location to the connection location.

3. The image forming apparatus according to claim 2, wherein, when the moving action unit comes into contact with the protruding portion, the moving action unit rotates to be displaced.

4. The image forming apparatus according to claim 1, wherein the transmission permission unit is a predetermined portion in the process unit, the connection switching unit includes:

a magnetic clutch that switches connection and separation between the driving source and the first driving unit;

a determination unit that determines that the process unit exists at the process mounting location, when the predetermined portion is detected; and a switching control unit that, when it is determined by the determination unit that the process unit exists at the process mounting location, controls a switching operation of the magnetic clutch such that the driving source and the first driving unit are connected to each other.

5. The image forming apparatus according to claim 1, wherein the process unit includes the photosensitive member, the rotation driving subject is the photosensitive member, and the first driving unit and the second driving unit are gears that are engaged to each other.

6. The image forming apparatus according to claim 1, wherein the second driving unit rotates the developing roller as the rotation driving subject, the first driving unit advances and retreats between a joint location where the first driving unit couples with the second driving unit provided in the process unit, and a non-joint location where the first driving unit does not couple with the second driving unit and attachment and detachment of the process unit with respect to the image forming apparatus are not hindered, and the image forming apparatus further includes an advancing action unit that, when the process unit exists at the process mounting location, advances the first driving unit to the joint location.

7. The image forming apparatus according to claim 1, wherein the transmission permission unit includes a protruding portion that is provided integrally with a rotation shaft of the developing roller, the second driving unit rotates the developing roller as the rotation driving subject, the first driving unit advances and retreats between a joint location where the first driving unit couples with the second driving unit provided in the process unit, and a non-joint location where the first driving unit does not couple with the second driving unit, and attachment and detachment of the process unit with respect to the image forming apparatus are not hindered, the connection switching unit enters the transmission state, when the protruding portion moves to a predetermined location at which the process unit is determined to exist at the process mounting location, and the image forming apparatus further includes an advancing action unit that advances the first driving unit to the joint location, when the protruding portion moves to the predetermined location.

8. A developing cartridge attachable to and detachable from an image forming apparatus comprising:

a developing roller that supplies a developer to a photosensitive member; and a transmission permission unit that transmits a rotation driving force generated by a driving source included in the image forming apparatus to a first driving unit provided in the image forming apparatus to rotate a rotation driving subject in the developing cartridge, when the developing cartridge exists at a mounting location with respect to the image forming apparatus.

9. The developing cartridge according to claim 8 which is attachable to and detachable from the image forming apparatus that comprises a connection switching unit that switches between a transmission state in which the rotation driving force generated by the driving source is transmitted to the first driving unit and a non-transmission state in which the rotation driving force generated by the driving source is not transmitted to the first driving unit, wherein the transmission permission unit switches a state of the connection switching unit into the transmission state, when the developing cartridge exists at the developing cartridge mounting location with respect to the image forming apparatus.

10. A process unit that includes a photosensitive member cartridge having a photosensitive drum on which an electrostatic latent image is formed, and a developing cartridge having a developing roller that supplies a developer to the photosensitive drum and is attachable to and detachable from the photosensitive member cartridge, the process unit being attachable to and detachable from an image forming apparatus, the developing cartridge including a developing roller that supplies a developer to the photosensitive drum, and a transmission permission unit that transmits a rotation driving force generated by a driving source included in the image forming apparatus to a first driving unit provided in the image forming apparatus to rotate a rotation driving subject in the process unit, when the process unit exists at a mounting location with respect to the image forming apparatus.

11. The process unit according to claim 10 which is attachable to and detachable from the image forming apparatus that comprises a connection switching unit that switches between a transmission state in which the rotation driving force generated by the driving source is transmitted to the first driving unit and a non-transmission state in which the rotation driving force generated by the driving source is not transmitted to the first driving unit, wherein the transmission permission unit switches a state of the connection switching unit into the transmission state, when the process unit exists at the process mounting location with respect to the image forming apparatus.

* * * * *